US012305316B2

(12) United States Patent
Song et al.

(10) Patent No.: US 12,305,316 B2
(45) Date of Patent: May 20, 2025

(54) ELECTRONIC APPARATUS AND CONTROL METHOD THEREOF

(71) Applicant: Samsung Electronics Co., Ltd., Suwon-si (KR)

(72) Inventors: Hyungseon Song, Suwon-si (KR); Kyungjae Kim, Suwon-si (KR); Jooyoo Kim, Suwon-si (KR); Taerim Kim, Suwon-si (KR); Miyoung Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 631 days.

(21) Appl. No.: 17/670,313

(22) Filed: Feb. 11, 2022

(65) Prior Publication Data

US 2022/0228308 A1 Jul. 21, 2022

Related U.S. Application Data

(63) Continuation of application No. PCT/KR2021/018117, filed on Dec. 2, 2021.

(30) Foreign Application Priority Data

Jan. 21, 2021 (KR) ..... 10-2021-0008557

(51) Int. Cl.
*D06F 34/18* (2020.01)
*D06F 34/08* (2020.01)

(52) U.S. Cl.
CPC ..... *D06F 34/18* (2020.02); *D06F 34/08* (2020.02)

(58) Field of Classification Search
None
See application file for complete search history.

(56) References Cited

U.S. PATENT DOCUMENTS 5,887,456 A * 3/1999 Tanigawa ..... D06F 35/006 68/18 C
11,180,883 B2 11/2021 Kim et al.
(Continued)

FOREIGN PATENT DOCUMENTS

CN 110106664 A 8/2019
JP 3067923 B2 7/2000
(Continued)

OTHER PUBLICATIONS

Supplementary European Search Report dated Mar. 25, 2024, in connection with European Patent Application No. 21921459.0, 6 pages.
(Continued)

*Primary Examiner* — Cristi J Tate-Sims

(57) ABSTRACT

An electronic apparatus includes a memory storing information on a trained first artificial intelligence model and second artificial intelligence model, a communication interface, and a processor. The processor is configured to, based on weight information of laundry before washing and washing course information being received from a washing machine, input the received weight information of the laundry before washing and the washing course information into the first artificial intelligence model to acquire weight information of the laundry after washing. The processor or is also configured to input the acquired weight information of the laundry after washing and drying course information into the second artificial intelligence model to acquire drying time information for a drying process. The processor is further configured to transmit the acquired drying time information to at least one of the washing machine or a drying machine through the communication interface.

18 Claims, 12 Drawing Sheets

(56) References Cited

U.S. PATENT DOCUMENTS

| | | | | |
|---|---|---|---|---|
| 11,203,829 | B2 | 12/2021 | Lee et al. | |
| 11,692,293 | B2 | 7/2023 | Kim et al. | |
| 2015/0113740 | A1 | 4/2015 | Lee | |
| 2017/0183811 | A1 | 6/2017 | Kang et al. | |
| 2019/0390392 | A1 | 12/2019 | Lee et al. | |
| 2020/0002873 | A1* | 1/2020 | Chae | G06N 20/00 |
| 2020/0024792 | A1 | 1/2020 | Lee | |
| 2020/0087829 | A1 | 3/2020 | Kim et al. | |
| 2021/0324561 | A1 | 10/2021 | Kim et al. | |

FOREIGN PATENT DOCUMENTS

| | | | |
|---|---|---|---|
| JP | 2008-006179 | A | 1/2008 |
| JP | 2010-194078 | A | 9/2010 |
| KR | 10-2009-0107849 | A | 10/2009 |
| KR | 10-1024919 | B1 | 3/2011 |
| KR | 10-2015-0047779 | A | 5/2015 |
| KR | 10-1549009 | B1 | 9/2015 |
| KR | 10-2017-0076397 | A | 7/2017 |
| KR | 10-2018-0074375 | A | 7/2018 |
| KR | 10-1914863 | B1 | 11/2018 |
| KR | 10-2019-0100116 | A | 8/2019 |
| KR | 20190092334 | A | 8/2019 |
| KR | 10-2019-0107610 | A | 9/2019 |
| KR | 10-2177970 | B1 | 11/2020 |
| WO | 2020213751 | A | 10/2020 |

OTHER PUBLICATIONS

International Search Report and Written Opinion of the International Searching Authority dated Mar. 8, 2022, in connection with International Application No. PCT/KR2021/018117, 14 pages.

* cited by examiner

ELECTRONIC APPARATUS AND CONTROL METHOD THEREOF

CROSS-REFERENCE TO RELATED APPLICATIONS

This application is a bypass continuation of International Application No. PCT/KR2021/018117, filed on Dec. 2, 2021, which is based on and claims priority to Korean Patent Application No. 10-2021-0008557, filed Jan. 21, 2021, in the Korean Intellectual Property Office, the disclosures of which are incorporated by reference herein in their entireties.

BACKGROUND

1. Field

The disclosure relates to an electronic apparatus, and a method for controlling thereof. More particularly, the disclosure relates to an electronic apparatus that manages home appliances and a method for controlling thereof.

2. Description of the Related Art

With the development of an electronic technology, various types of electronic products have been developed and widely distributed. Particularly, home appliances used at home have been continuously developed in recent years to satisfy needs of users.

Recently, not only washing machines, but also devices providing various washing-related functions such as drying machines and air dressers have been supplied.

According to an embodiment, there is a problem that when a drying machine predicts and displays an administration time after sufficiently tumbling laundry, it takes a long time to display a predicted time based on a measured weight. In addition, there is a problem in that it is difficult for the user to know a total required time at the start of washing because the administration time is individually predicted after the laundry is put into a washing machine and a drying machine, respectively.

SUMMARY

The disclosure is to provide an electronic apparatus for predicting and providing a total required time according to a washing process of a washing machine and a drying process of a drying machine, and a method for controlling thereof.

According to an embodiment of the disclosure, an electronic apparatus includes a memory storing information on a trained first artificial intelligence model and second artificial intelligence model, a communication interface, and a processor configured to, based on weight information of laundry before washing and washing course information being received from a washing machine, input the received weight information of laundry before washing and the washing course information into the first artificial intelligence model to acquire weight information of laundry after washing, input the acquired weight information of laundry after washing and drying course information into the second artificial intelligence model to acquire drying time information required for a drying process, and transmit the acquired drying time information to at least one of the washing machine or a drying machine through the communication interface.

The processor may, based on washing time information corresponding to the washing course information and the acquired drying time information, acquire total required time information, and transmit the acquired total required time information to the washing machine through the communication interface.

The processor may receive the washing time information corresponding to the washing course information from the washing machine.

The weight information of the laundry before washing may include at least one of a weight of dried laundry before washing or a weight of wet laundry before washing.

The processor may acquire drying course information corresponding to the washing course information based on the received washing course information.

The first artificial intelligence model may be trained by using the weight information of the laundry before washing and the washing course information as input data and the weight information of the laundry after washing as output data, and wherein the second artificial intelligence model is configured to be trained by using the weight information of the laundry after washing and the drying course information as input data and the drying time information as output data.

The processor may receive the washing course information and the drying course information corresponding to the washing course information from a user terminal through the communication interface.

The processor may, based on the washing time information and the acquired drying course information corresponding to the washing course information, acquire the total required time information, and transmit the acquired total required time information to the user terminal through the communication interface.

The processor may input the weight information of the laundry before washing, the washing course information, and washing option information into the first artificial intelligence model to acquire the weight information of the laundry after washing, and input the weight information of the laundry after washing, the drying course information, and drying option information into the second artificial intelligence model to acquire drying time information.

According to an embodiment of the disclosure, a washing machine includes a display, and a processor configured to transmit weight information of laundry before washing and washing course information to an electronic apparatus, and based on drying time information used for a drying process predicted by the electronic apparatus being received, based on the received drying time information and washing time information corresponding to the washing course information, control the display to display total required time information, and wherein the electronic apparatus is configured to input the weight information of the laundry received from the washing machine and the washing course information into a first artificial intelligence model to acquire weight information of laundry after washing, input the acquired weight information of the laundry after washing and drying course information into a second artificial intelligence model to acquire drying time information, and transmit the acquired drying time information to the washing machine.

Meanwhile, according to an embodiment of the disclosure, a method for controlling an electronic apparatus that stores information on a trained first artificial intelligence model and second artificial intelligence model, the method includes based on weight information of laundry before washing and washing course information being received from a washing machine, inputting the received weight information of laundry before washing and the washing course information into the first artificial intelligence model to acquire weight information of laundry after washing inputting the acquired weight information of laundry after washing and drying course information into the second artificial intelligence model to acquire drying time information required for a drying process, and transmitting the acquired drying time information to at least one of the washing machine or a drying machine.

The transmitting the acquired drying time information to at least one of the washing machine or a drying machine may include based on washing time information corresponding to the washing course information and the acquired drying time information, acquiring total required time information, and transmit the acquired total required time information to the washing machine.

The method may further include receiving the washing time information corresponding to the washing course information from the washing machine.

The weight information of the laundry before washing may include at least one of a weight of dried laundry before washing or a weight of wet laundry before washing.

The method may further include acquiring drying course information corresponding to the washing course information based on the received washing course information.

The first artificial intelligence model may be trained by using the weight information of the laundry before washing and the washing course information as input data and the weight information of the laundry after washing as output data, and wherein the second artificial intelligence model is configured to be trained by using the weight information of the laundry after washing and the drying course information as input data and the drying time information as output data.

The method may receive the washing course information and the drying course information corresponding to the washing course information from a user terminal.

The method may further include, based on the washing time information and the acquired drying course information corresponding to the washing course information, acquiring the total required time information, and transmitting the acquired total required time information to the user terminal.

The acquiring the weight information of the laundry after washing may include inputting the weight information of the laundry before washing, the washing course information, and washing option information into the first artificial intelligence model to acquire the weight information of the laundry after washing, and wherein the acquiring the drying time information may include inputting the weight information of the laundry after washing, the drying course information, and drying option information into the second artificial intelligence model to acquire drying time information.

According to various embodiments, a total required time that is used for a washing process and a drying process may be provided at the start of washing, thereby improving user's convenience.

According to various embodiments, a total required time that is used for a washing process and a drying process may be provided at the start of washing, thereby improving user's convenience.

Before undertaking the detailed description below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1A:
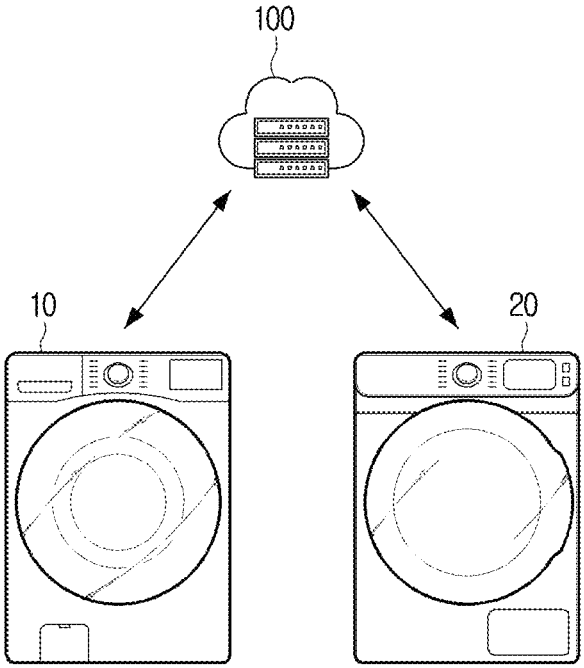
FIGS. 1A and 1B illustrate example configurations of an electronic system according to an embodiment.

FIGS. 1A through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, the disclosure will be described in detail with reference to the accompanying drawings.

The terms used in example embodiments will be briefly explained, and example embodiments will be described in greater detail with reference to the accompanying drawings.

Terms used in the disclosure are selected as general terminologies currently widely used in consideration of the configuration and functions of the disclosure, but can be different depending on intention of those skilled in the art, a precedent, appearance of new technologies, or the like. Further, in specific cases, terms may be arbitrarily selected. In this case, the meaning of the terms will be described in the description of the corresponding embodiments. Accordingly, the terms used in the description should not necessarily be construed as simple names of the terms, but be defined based on meanings of the terms and overall contents of the disclosure.

In the present application, the terms "include" and "comprise" designate the presence of features, numbers, steps, operations, components, elements, or a combination thereof that are written in the specification, but do not exclude the presence or possibility of addition of one or more other features, numbers, steps, operations, components, elements, or a combination thereof.

The expression at least one of A and/or B represents any one of either "A" or "B" or "A and B".

The expression "1", "2", "first", or "second" as used herein may modify a variety of elements, irrespective of order and/or importance thereof, and only to distinguish one element from another. Accordingly, without limiting the corresponding elements.

When an element (e.g., a first element) is "operatively or communicatively coupled with/to" or "connected to" another element (e.g., a second element), an element may be directly coupled with another element or may be coupled through the other element (e.g., a third element).

Singular forms are intended to include plural forms unless the context clearly indicates otherwise. The terms "include", "comprise", "is configured to," etc., of the description are used to indicate that there are features, numbers, steps, operations, elements, parts or combination thereof, and they should not exclude the possibilities of combination or addition of one or more features, numbers, steps, operations, elements, parts or a combination thereof.

In the disclosure, a 'module' or a 'unit' performs at least one function or operation and may be implemented by hardware or software or a combination of the hardware and the software. In addition, a plurality of 'modules' or a plurality of 'units' may be integrated into at least one module and may be at least one processor except for 'modules' or 'units' that should be realized in a specific hardware.

Hereinafter, exemplary embodiments will be described in greater detail with reference to the accompanying drawings.

Figure 1B:
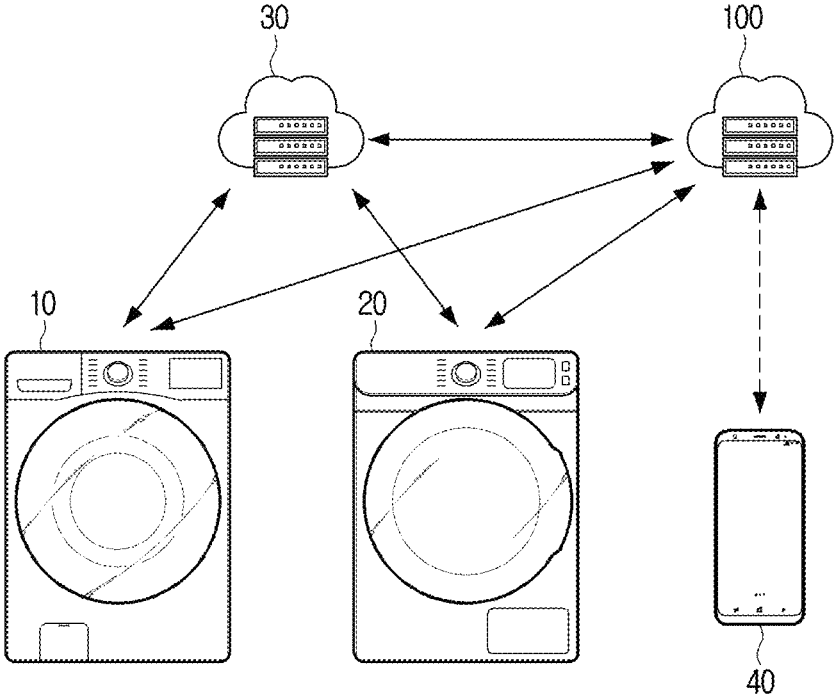

FIGS. 1A and 1B illustrate example configurations of an electronic system according to an embodiment.

Referring to FIG. 1A, an electronic system may include an electronic apparatus 100 and a plurality of home appliances such as the washing machine 10 and the drying machine 20.

The electronic apparatus 100 may control and manage various registered devices (e.g., home appliances and Internet of Things (IoT), or the like). For example, the electronic apparatus 100 may register and manage devices for each user account. According to an embodiment, the electronic apparatus 100 may be implemented as a server, for example, a cloud server, but is not limited thereto.

The washing machine 10 and the draying machine 20 may be Internet of Things (IoT) devices that can be controlled by a signal received from the electronic apparatus 100. According to an embodiment, it may be implemented as a device that performs various functions related to washing such as a washing machine that washes laundry using water and detergent and dehydrates wet laundry, a drying machine that performs a drying function on clothes, or the like, and a clothes cleaner that performs a cleaning function on clothes, or the like. Particularly, according to an embodiment of the disclosure, the control the washing machine 10 and the drying machine 20 may include a washing machine and a drying machine. For convenience of description, it is assumed that the washing machine 10 and the drying machine 20 are devices registered in a same user account.

The electronic apparatus 100 may communicate with the washing machine 10 and the drying machine 20 with an access point or perform communication with the washing machine 10 and the drying machine 20 through a mobile communication network such as LTE, 5G, or the like. Particularly, the electronic apparatus 100 may learn an artificial intelligence model based on usage information received from the washing machine 10 and the drying machine 20, and provide total required time information related to washing and drying processes using a trained artificial intelligence model.

Referring to FIG. 1B, a system may include an electronic apparatus 100, a washing machine 10, a drying machine 20, a data server 30, and a user terminal 40.

According to an embodiment illustrated in FIG. 1B, the electronic apparatus 100 may receive usage information of the washing machine 10 and the drying machine 20 through a data server 30 instead of directly receiving the usage information from the washing machine 10 and the drying machine 20. In this case, the data server 30 may be implemented as a database server that stores and manages usage information of the washing machine 10 and the drying machine 20. For example, the data server 30 may be implemented as a server that provides a repair service for the washing machine 10 and the drying machine 20 based on usage information of the washing machine 10 and the drying machine 20. However, the disclosure is not limited thereto.

According to another embodiment illustrated in FIG. 1B, the electronic apparatus 100 may communicate with a user terminal 40.

The user terminal 40 may download and install an application from a server (not shown) that provides an application. According to an embodiment, the user terminal 40 may be implemented as a user terminal such as a smartphone or a tablet. However, the disclosure is not limited thereto, and the user terminal 40 may be implemented as a laptop computer, a smart TV, a mobile phone, a personal digital assistant (PDA), a laptop, a media player, an e-book terminal, a digital broadcasting terminal, a navigation, an MP3 player, a digital camera, and a home appliance and other mobile or non-mobile computing devices, or wearable terminals such as watches, glasses, hair bands, rings, or the like. Here, the washing machine 10 and the drying machine 20 may be Internet of Things (IoT) devices that can be controlled through an application installed in the user terminal 40.

The user may execute an application in the user terminal 40 and input a user account to log into the electronic apparatus 100, for example, a server through the input user account, and perform communication with the electronic apparatus 100 based on the logged-in user account. The electronic apparatus 100 may register a laundry-related device such as the washing machine 10 to a corresponding user account. For example, the user terminal 40 may perform communication with the laundry-related device such as the washing machine 10 operating in an access point (AP) mode, and transmit information on the access point (i.e., Wi-Fi access point) to the laundry-related device such as the washing machine 10. For example, the user terminal 40 may display a list of connectable access points on a display of the user terminal 40, and provide the information on the access points selected according to a user command on the list to the washing machine 10 and the drying machine. In this case, the washing machine 10 and the drying machine 20 may perform communication connection with the access point using the information on the access point received from the user terminal 40, and connect to the electronic apparatus 100 through the access point. Accordingly, when the washing machine 10 and the drying machine 20 are connected through the access point, the electronic apparatus 100 may register the washing machine 10 and the drying machine 20 in the logged-in user account.

Hereinafter, various embodiments in which the electronic apparatus 100 provides total required time information from the washing machine 10 according to various embodiments of the disclosure will be described.

Figure 2:
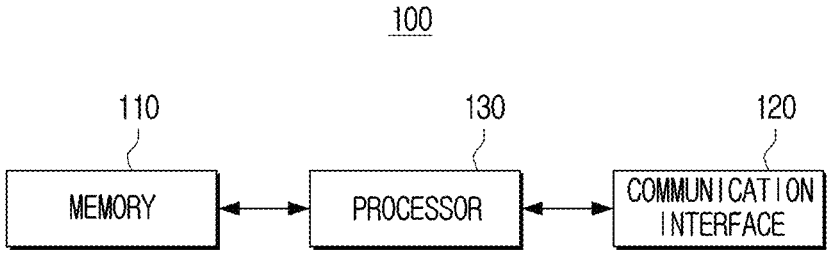
FIG. 2 illustrates a block diagram of a configuration of an electronic apparatus according to an embodiment.

FIG. 2 illustrates a block diagram of a configuration of an electronic apparatus 100 according to an embodiment.

The electronic apparatus 100 according to FIG. 2 includes a memory 110, a communication interface 120, and a processor 130.

The electronic apparatus 100 may be implemented as a server, for example, as a server in which a cloud computing environment is built. The disclosure is not limited thereto, and any device that processes data using an artificial intelligence model is not limited and may be applied.

The memory 110 may store data that is used for various embodiments of the disclosure. The memory 110 may be implemented in the form of a memory embedded in the electronic apparatus 100 or may be implemented in the form of a memory capable of communicating with the electronic apparatus 100 (or detachable) depending on a purpose of data storage. For example, data for driving the electronic apparatus 100 may be stored in a memory embedded in the electronic apparatus 100, and data for an extending function of the electronic apparatus 100 may be stored in a memory capable of communicating with the electronic apparatus 100. Meanwhile, the memory embedded in the electronic apparatus 100 may be implemented as at least one of a volatile memory (e.g., dynamic RAM (DRAM), static RAM (SRAM), or synchronous dynamic RAM (SDRAM), etc.), non-volatile memory (e.g., one time programmable ROM (OTPROM), programmable ROM (PROM), erasable and programmable ROM (EPROM), electrically erasable and programmable ROM (EEPROM), mask ROM, flash ROM, flash memory (e.g., NAND flash or NOR flash, etc.), a hard drive, or a solid state drive (SSD). In addition, the memory capable of communicating with the electronic apparatus 100 may be implemented as a memory card (e.g., a compact flash (CF), secure digital (SD), micro secure digital (Micro-SD), mini secure digital (Mini-SD), extreme digital (xD), multimedia card (MMC), etc.), external memory capable of being connected to a USB port (e.g. a USB memory).

According to an embodiment, the memory 110 may store at least one instruction for controlling the electronic apparatus 100 or a computer program including instructions.

According to another example, the memory 110 may store information about an artificial intelligence model including a plurality of layers. Here, storing information about the artificial intelligence model may mean various information related to an operation of the artificial intelligence model, for example, information on a plurality of layers included in the artificial intelligence model, parameters used in each of the plurality of layers (e.g., filter coefficients, bias, etc.) are stored. For example, the memory 110 may store information on a first artificial intelligence model trained to acquire information on a weight of laundry after washing according to an embodiment, and information on a second artificial intelligence model trained to acquire drying time information. However, when the processor 130 is implemented as hardware dedicated to the artificial intelligence model, information about the artificial intelligence model may be stored in an internal memory of the processor 130.

According to an embodiment, the memory 110 may be implemented as a single memory that stores data generated in various operations according to the disclosure. However, according to another embodiment, the memory 110 may be implemented to include a plurality of memories each storing different types of data or each storing data generated in different operations.

The communication interface 120 may communicate with the washing machine 10 and the drying machine 20.

According to an embodiment, the communication interface 120 may include a wireless communication module that communicates with the washing machine 10 and the drying machine 20. According to another embodiment, the communication interface 120 may additionally communicate with at least one of the data server 30 and the user terminal 40.

For example, the communication interface 120 may include a wireless communication module, for example, a Wi-Fi module. However, the disclosure is not limited thereto, and the communication interface 120 may perform communication according to various wireless communication standards such as ZigBee, 3rd Generation (3G), 3rd Generation Partnership Project (3GPP), Long Term Evolution (LTE), LTE advanced (LTE-A), 4th Generation (4G), 5th Generation (5G), or the like, and Infrared Data Association (IrDA) technology, or the like, in addition to the communication methods described above.

The processor 130 may be electrically connected to the memory 110 to control an overall operation of the electronic apparatus 100. The processor 130 may include one or a plurality of processors. Specifically, the processor 130 may perform an operation of the electronic apparatus 100 according to various embodiments of the disclosure by executing at least one instruction stored in the memory 110.

According to an embodiment, the processor 130 may include a digital signal processor (DSP), a microprocessor (microprocessor), a graphics processing unit (GPU), an artificial intelligence (AI) processor, a neural processing unit (NPU), a time controller (TCON), but is not limited thereto, or may include one or more of a central processing unit (CPU), a micro controller unit (MCU), a micro processing unit (MPU), a controller, an application processor (AP), a communication processor (CP), an ARM processor, or may be defined by the term. In addition, the processor 130 may be implemented as a system on chip (SoC) with a built-in processing algorithm, large scale integration (LSI), or an application specific integrated circuit (ASIC) or field programmable gate array (FPGA).

In addition, the processor 130 for executing the artificial intelligence model according to an embodiment may be implemented through a combination of a general-purpose processor such as a CPU, an AP, a digital signal processor (DSP), etc., a graphics-only processor such as a GPU, a vision processing unit (VPU), or an artificial intelligence-only processor such as NPU and software. The processor 130 may control to process input data according to a predefined operation rule or an artificial intelligence model stored in the memory 110. Alternatively, when the processor 130 is a dedicated processor (or artificial intelligence-only processor), it may be designed with a hardware structure specialized for processing a specific artificial intelligence model. For example, hardware specialized for processing a specific artificial intelligence model may be designed as a hardware chip such as an ASIC, FPGA, or the like. When the processor 130 is implemented as a dedicated processor, it may be implemented to include a memory for implementing an embodiment of the disclosure, or may be implemented to include a memory processing function for using an external memory.

According to an embodiment, the processor 130 may use the first and second artificial intelligence models to acquire at least one of a drying time or a total required time and transmit the acquired time information to the washing machine 10 through the communication interface 120. However, the corresponding information may be transmitted to the drying machine 20 in some cases.

According to an embodiment, the artificial intelligence model may be implemented as a convolutional neural network (CNN), a recurrent neural network (RNN), a restricted Boltzmann machine (RBM), a deep belief network (DBN), a bidirectional recurrent deep neural network (BRDNN), or a deep Q-network, but is not limited thereto.

According to an embodiment, when weight information of laundry and washing course information are received from the washing machine 10, the processor 130 may input the received weight information of the laundry before washing and the washing course information to the first artificial intelligence model to acquire weight information of the laundry after washing by inputting it. In addition, the processor 130 may acquire not only weight information of the laundry before washing and the washing course information, but also weight information of the laundry after washing by inputting washing option information into the first artificial intelligence model. Here, the weight information of the laundry before washing input to the first artificial intelligence model may include at least one of a weight of dried laundry before washing and a weight of wet laundry before washing. For example, the processor 130 may receive only the weight of the dried laundry before washing from the washing machine 10, but may also receive both the weight of the dried laundry before washing and the weight of the wet laundry before washing.

In addition, the processor 130 may acquire drying time information by inputting weight information of the laundry and drying course information after washing acquired through the first artificial intelligence model to the second artificial intelligence model. In addition, the processor 130 may acquire drying time information by inputting not only laundry weight information and drying course information but also drying option information after washing to the second artificial intelligence model.

Subsequently, the processor 130 may transmit the acquired drying time information or the total required time information to at least one of the washing machine and the drying machine.

According to an embodiment, the processor 130 may transmit the acquired drying time information to at least one of the washing machine 10 and the drying machine 20.

According to another embodiment, the processor 130 may acquire the total required time information based on washing time information corresponding to the washing course information and the acquired drying time information, and transmit the acquired total required time information to the washing machine 10. In this case, the processor 130 may receive washing time information corresponding to the washing course information from the washing machine 10.

According to an embodiment, the processor 130 may acquire drying course information to be input into the second artificial intelligence model corresponding to the washing course information based on the washing course information received from the washing machine 10.

According to another embodiment, the processor 130 may receive washing course information selected by the user and drying course information corresponding to the washing course information from the user terminal 40. Alternatively, the weight information of the laundry before washing may be received from the user terminal 40.

Meanwhile, course information and option information (e.g., option information for each course) may include various types of information. For example, a washing course may include a standard course, a wool washing course, a baby washing course, a soft bubble, or the like, and option information may include a washing time, water temperature, drying time, or the like. However, in the case of a drying machine, the course information may include a duvet/dust removal, a sterilization course, a strong course, or the like, and the option information may include a drying level, a drying time, or the like. In the case of a clothes purifier, the course information may include a standard course, a fine dust course, a rapid course, a sterilization course, or the like, and the option information may include a management level, a management time, or the like. However, this is an example of course information and option information, and various information may be added.

Figure 3A:
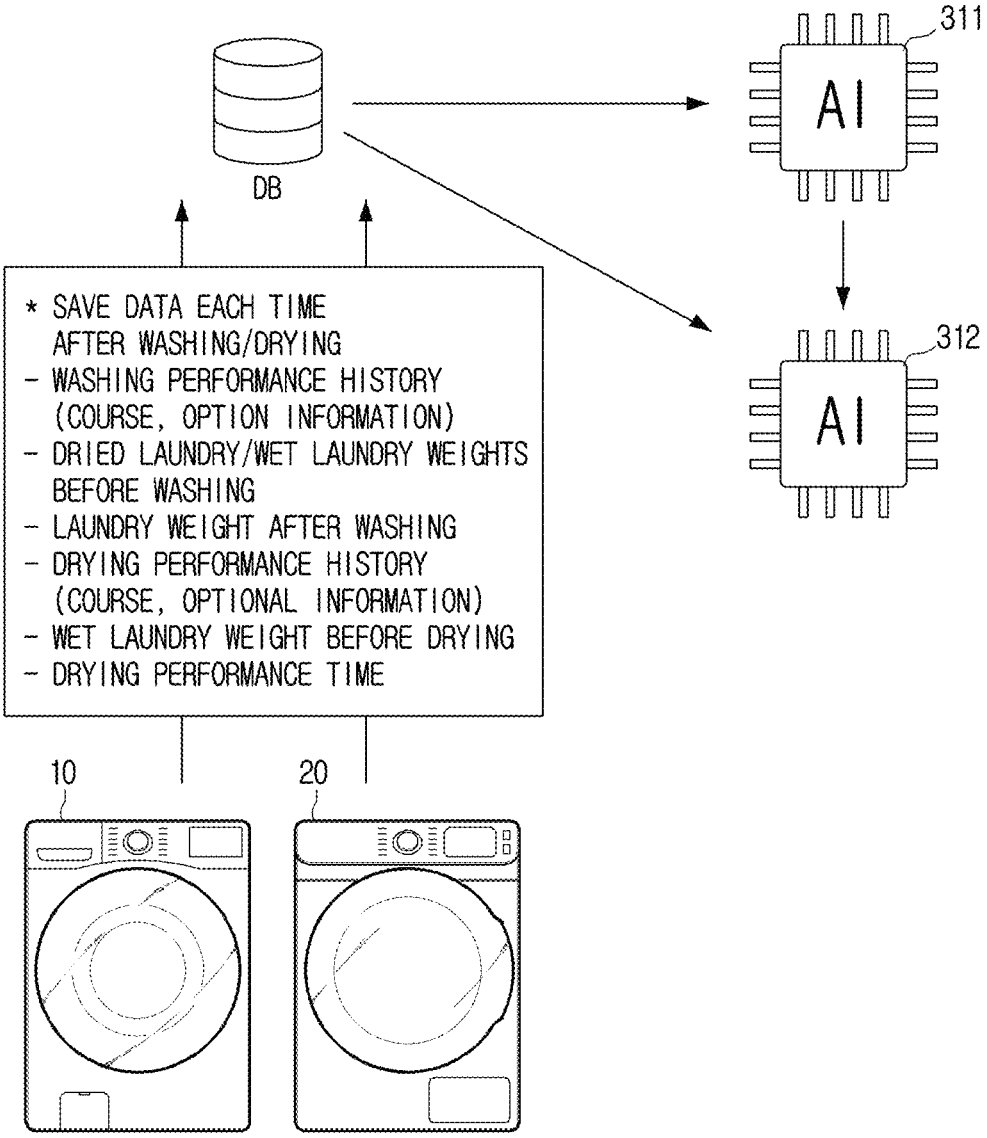
FIGS. 3A and 3B are illustrate a method of learning an artificial intelligence model according to an embodiment.
Figure 3B:
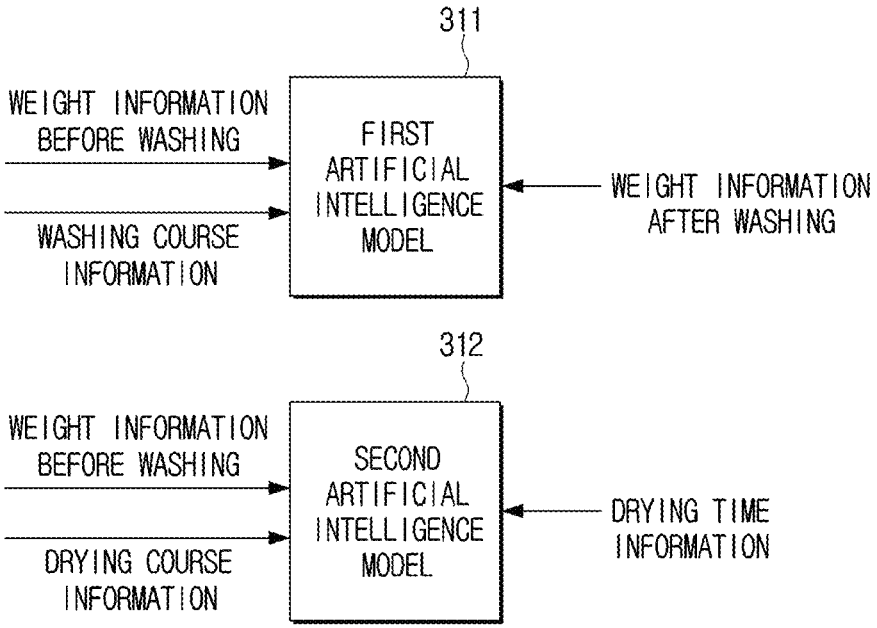

FIGS. 3A and 3B illustrate a method of learning an artificial intelligence model according to various embodiments of the disclosure.

According to an embodiment, the artificial intelligence model may be trained based on a pair of input training data and output training data, or may be trained based on input training data. Here, the learning of the artificial intelligence model means that a basic artificial intelligence model (e.g., an artificial intelligence model including an arbitrary random parameter) is trained using a plurality of training data by a learning algorithm, and thus a predefined action rule or artificial intelligence model set to perform a desired characteristic (or, purpose) is generated. Such learning may be performed through the electronic apparatus 100, but is not limited thereto, and may be performed through a separate server and/or system. Examples of the learning algorithm may include, but are not limited to, supervised learning, unsupervised learning, semi-supervised learning, or reinforcement learning. However, this is an example of supervised learning, and it may train an artificial intelligence model based on unsupervised learning that trains an artificial intelligence model by inputting only input data without using recommended administrative information as output data.

For example, as shown in FIG. 3A, the electronic apparatus 100 may store data according to washing and drying processes in DB, and may train the first artificial intelligence model 311 and the second artificial intelligence model 312 based on the information. For example, laundry history information (washing course information, laundry option information), dried laundry/wet laundry weights before washing, laundry weight after washing, drying history information (drying course information, drying option information), a weight of wet laundry before drying, drying time, etc. may be used in the first artificial intelligence model 311 and the second artificial intelligence model 312.

According to an embodiment, as shown in FIG. 3B, the first artificial intelligence model 311 may be trained by using a weight before washing, washing course information (and washing option information), and a weight after washing included in washing history information as input/output training data pairs, respectively. For example, as shown in FIG. 3B, the first artificial intelligence model 311 may be trained using input data of weight before washing and washing course information, and output data of weight after washing as input/output training data pairs. In addition, the second artificial intelligence model 312 be trained by the weight after washing (weight of wet laundry before drying), drying course information (and drying option information) and drying time information included in the drying history information as input/output training data pairs, respectively. For example, as illustrated in FIG. 3B, the second artificial intelligence model 312 may be trained by using input data of weight after washing and drying course information, and output data of drying time information as input/output training data pairs.

However, this is an example of supervised learning, and it may train the artificial intelligence model based on unsupervised learning that trains the artificial intelligence model by inputting only input data without using recommended administrative information as output data.

However, according to another embodiment, when the amount of usage information of the washing machine 10 and the drying machine 20 is insufficient to train the artificial intelligence model, the artificial intelligence model may be trained by using the usage information of the same tendency as the user's usage information. Accordingly, even when the usage information of the washing machine 10 and the drying machine 20 are not sufficiently accumulated, the artificial intelligence model may be trained. For example, the processor 130 may group a plurality of laundry-related devices into at least one group by using a K-means algorithm, and train the artificial intelligence model using usage information of a group to which the user having a similar tendency to the user belongs.

According to another embodiment, the first and second artificial intelligence models 311 and 312 may be trained based on usage history information acquired from the other washing machine and the other drying machine. For example, when data according to the usage history information of the washing machine 10 and drying machine 20 of a user is insufficient, learning of the artificial intelligence model may be delayed. Accordingly, the processor 130 may learn the first and second artificial intelligence models 311 and 312 based on usage history information acquired from washing and drying machines of the other users who have similar usage tendencies to the user.

According to another embodiment, not only usage history information but also various context information, for example, weather information, time information, device information, or the like may be additionally used in the learning of the first and second artificial intelligence models 311 and 312. Here, the device information may include various information related to the washing machine 10, for example, various information such as a function, model, type, manufacturer, location, or the like, and the time information may include various information related to time, day of the week, holiday, or the like, and the weather information may include various information related to the weather, such as temperature, dust, ozone index, precipitation, wind, humidity, or the like.

Meanwhile, the trained first artificial intelligence model 311 may output weight information after washing and a probability value corresponding to the corresponding information. For example, when a plurality of weight information after washing is output from the first artificial intelligence model 311, the processor 130 may acquire weight information after a final washing based on a corresponding probability value. Also, the trained second artificial intelligence model 312 may output drying time information and a probability value corresponding to the corresponding information. For example, when a plurality of drying time information are output from the second artificial intelligence model 312, the processor 130 may acquire final drying time information based on a corresponding probability value.

In this case, an output part of the artificial intelligence model may be implemented to enable softmax processing. Here, softmax is a function that normalizes all input values to values between 0 and 1 and makes a sum of the output values equal to 1, and function to output a probability value of each class, that is, each recommended administrative information. In some cases, the output part of the artificial intelligence model may be implemented to enable Argmax processing. Argmax is a function that selects the most probable one among a plurality of labels. Here, a probability value for each class may have a function of selecting a ratio having the largest value among the probability values. In other words, when each output part of the artificial intelligence model is Argmax-processed, only one piece of information having the highest probability value may be output.

Referring back to FIG. 2, the processor 130 may transmit drying time information acquired from the second artificial intelligence model 312 or total required time information acquired based on the drying time information to at least one of the washing machine 10, the drying machine 20 or the user terminals 40.

Figure 4:
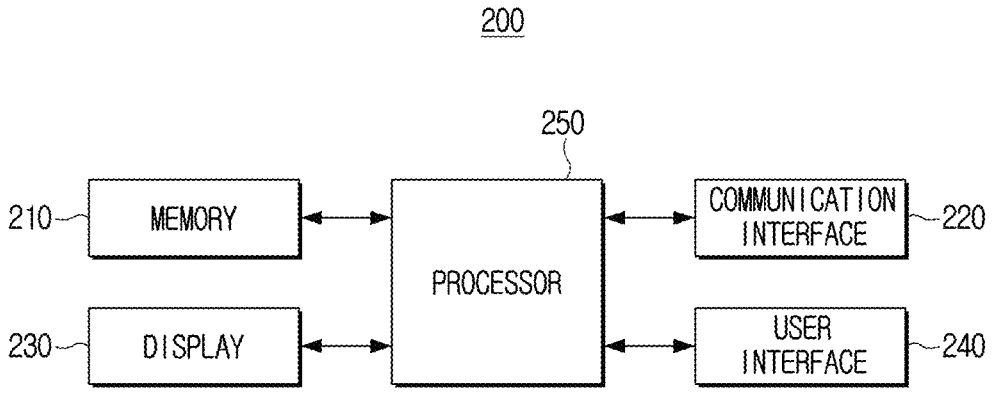
FIG. 4 illustrates a block diagram of a configuration of a washing machine according to another embodiment.

FIG. 4 illustrates a block diagram of a configuration of a washing machine according to another embodiment.

According to FIG. 4, the electronic apparatus 200 may include a memory 210, a communication interface 220, a display 230, a user interface 240, and a processor 250. Here, the electronic apparatus 200 may be implemented as the washing machine 10 or the user terminal 40 shown in FIGS. 1A and 1B.

The memory 210 stores various modules to drive the electronic apparatus 200. For example, software that includes a base module, a sensing module, a communication module, a presentation module, a web browser module, and a service module, or the like, may be stored in the memory 210.

According to an embodiment, when the electronic apparatus 200 is implemented as the washing machine 10, various usage information acquired from the washing machine 10 may be stored.

According to another embodiment, when the electronic apparatus 200 is implemented as the user terminal 40, the memory 210 may store an application for controlling an external device (e.g., application described in FIG. 1B). Here, the application may be an application for remotely controlling home appliances or the like in a home.

The communication interface 220 may communicate with an external device (e.g., the electronic apparatus 100 of FIGS. 1A and 1B).

According to an embodiment, the communication interface 220 may include, for example, a Wi-Fi module. The Wi-Fi module may perform communication according to at least one standard version of 802.11ac among 802.11a, 802.11b, 802.11g, and 802.11n, but is not limited thereto and may include a new version developed later. However, the disclosure is not limited thereto, and the communication interface 220 may perform communication according to various wireless communication standards such as ZigBee, 3rd Generation (3G), 3rd Generation Partnership Project (3GPP), Long Term Evolution (LTE), LTE advanced (LTE-A), 4th generation (4G), 5th Generation (5G), or the like, infrared data association (IrDA) technology, or the like.

The display 230 may be implemented as a display including a self-luminous device or a display including a non-light-emitting device and a backlight. For example, various types of displays such as Liquid Crystal Display (LCD), Organic Light Emitting Diodes (OLED) displays, Light Emitting Diodes (LEDs), micro LEDs, Mini LEDs, Plasma Display Panel (PDP), Quantum dot (QD) displays, Quantum dot light-emitting diodes (QLEDs) may be implemented. The display 230 may include a driving circuit, a backlight unit, or the like which may be implemented in forms such as an a-si TFT, a low temperature poly silicon (LTPS) TFT, an organic TFT (OTFT), or the like. Meanwhile, the display 230 may be implemented as a touch screen combined with a touch sensor, a flexible display, a rollable display, a three-dimensional display (3D display), a display in which a plurality of display modules are physically connected, or the like.

The user interface 240 may be implemented to be device such as button, touch pad, mouse and keyboard, or may be implemented to be touch screen that can also perform the function of the display. The button may include various types of buttons, such as a mechanical button, a touch pad, a wheel, etc., which are formed on the front, side, or rear of the exterior of a main body.

The processor 250 may control the overall operation of the electronic apparatus 200.

The processor 250 may control the display 230 to display a UI screen. The UI screen may include various contents such as an image, a moving image, a text, music, or the like, an application execution screen including the various contents, a web browser screen, a graphic user interface (GUI) screen, or the like.

According to an embodiment, the processor 250 may control the display 230 to provide a UI for controlling the electronic apparatus 200 or a UI screen related to an external device. In this case, the UI screen may be provided through an application that is software directly used by the user on OS. In this case, the application may be provided in the form of an icon interface on a screen of the display 230. According to an embodiment, when the electronic apparatus 200 is implemented as the user terminal 40, the processor 250 may control the display 230 to provide a UI screen related to an external device. In this case, the external device may be the washing machine 10 or the drying machine 20.

According to an embodiment, the UI screen provided through the application may provide various information related to an operation of the washing machine 10 or the drying machine 20, and functions of a control panel capable of input and output for controlling the washing machine. In other words, the UI screen is a configuration for a user and an interface, and may include an input interface for receiving the user's input and an output interface for displaying information (e.g., control information) according to the user's input.

According to an embodiment, the electronic apparatus 200 may provide a UI screen including a total required time according to a washing process and a drying process at a washing start time.

FIGS. 5, FIGS. 6A to 6C illustrate views of a UI screens according to an embodiment.

Figure 5:
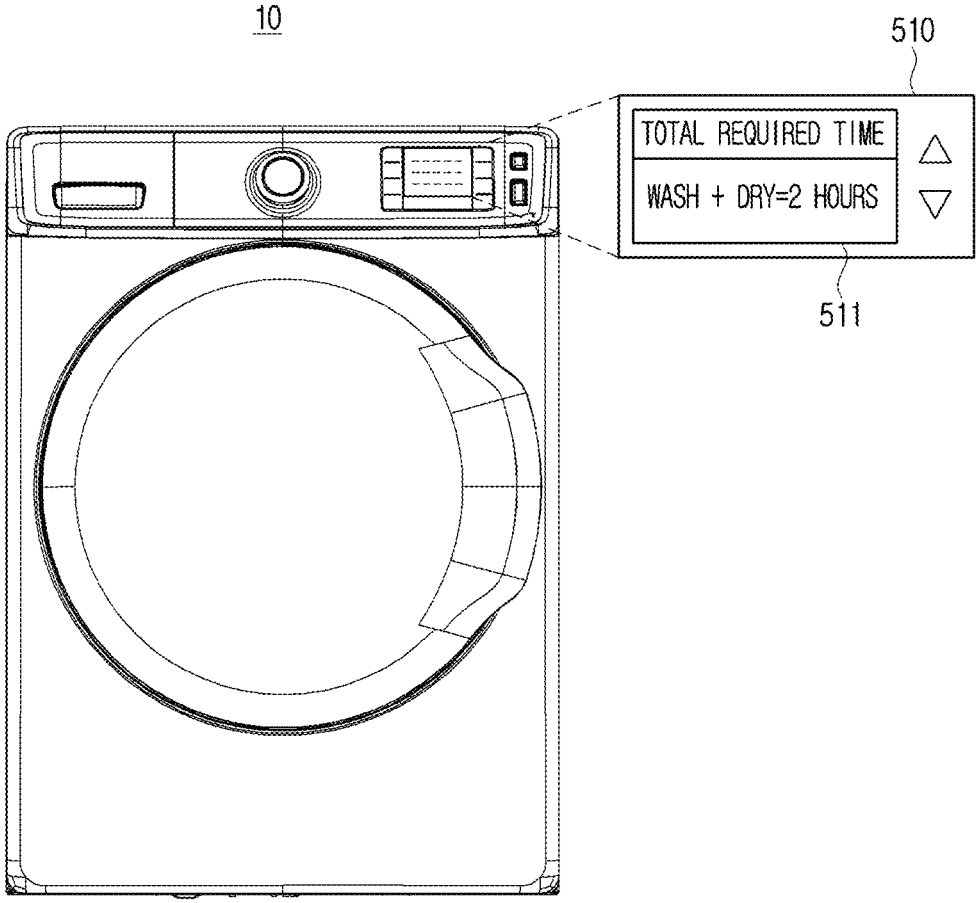
FIGS. 5, 6A, 6B and 6C illustrate views of user interface screens according to an embodiment.

FIG. 5 illustrates a UI screen when the electronic apparatus 200 is implemented as a laundry-related device such as the washing machine 10.

Referring to FIG. 5, a UI screen 510 providing total required time information 511 according to a predetermined event may be provided. Here, the predetermined event may be an event in which laundry is put into the washing machine 10 and washing course information is selected.

Figure 6A:
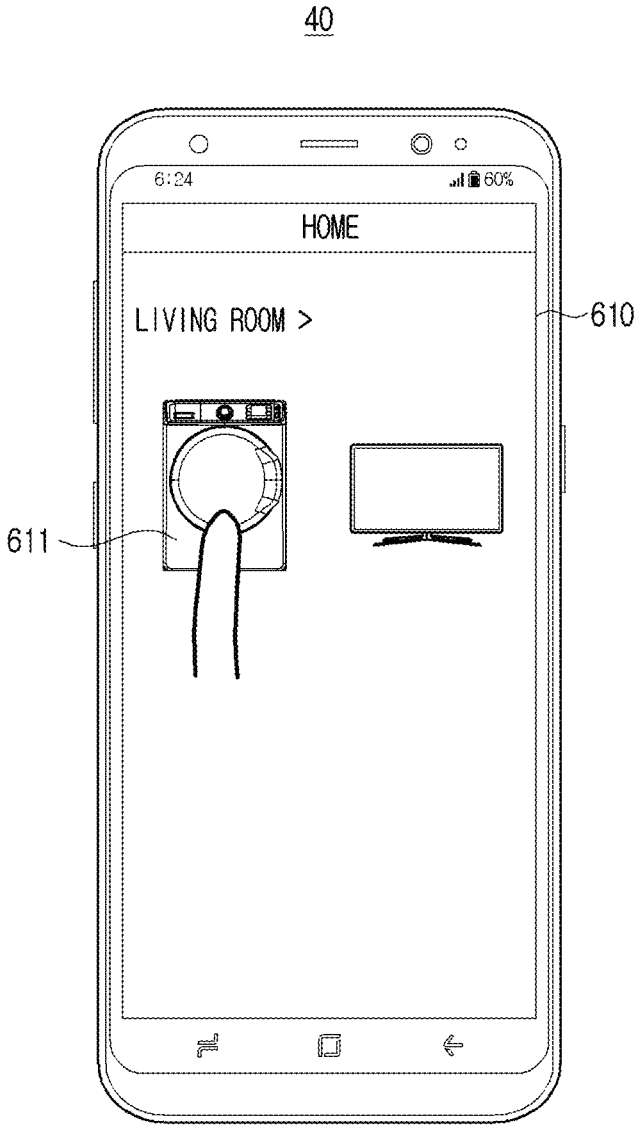
Figure 6B:
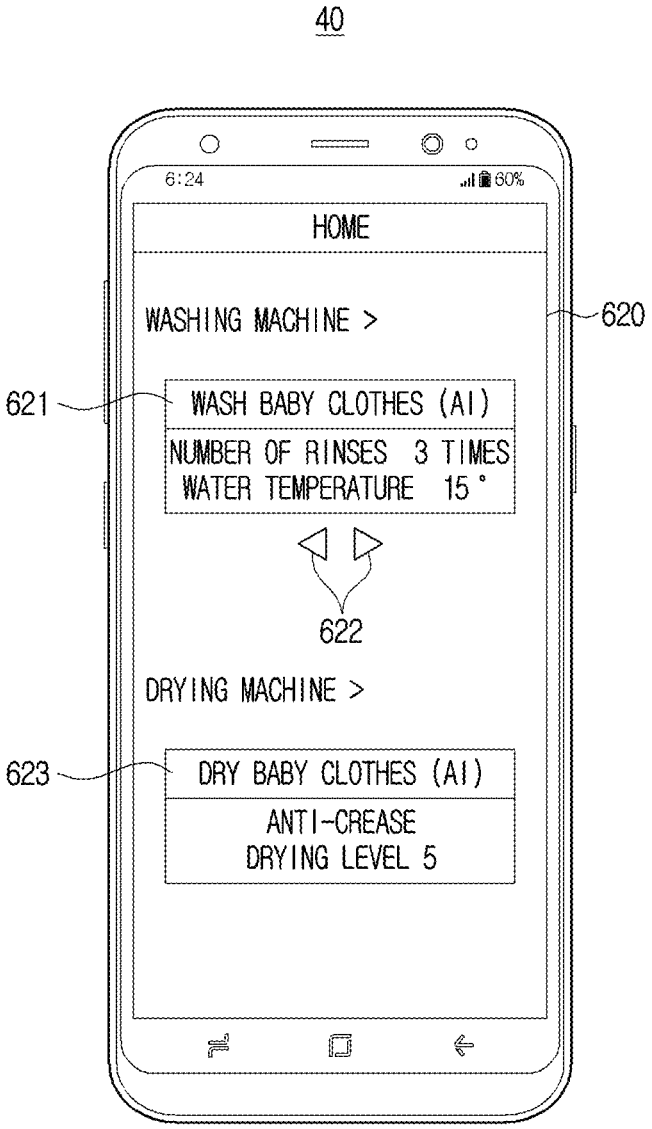
Figure 6C:
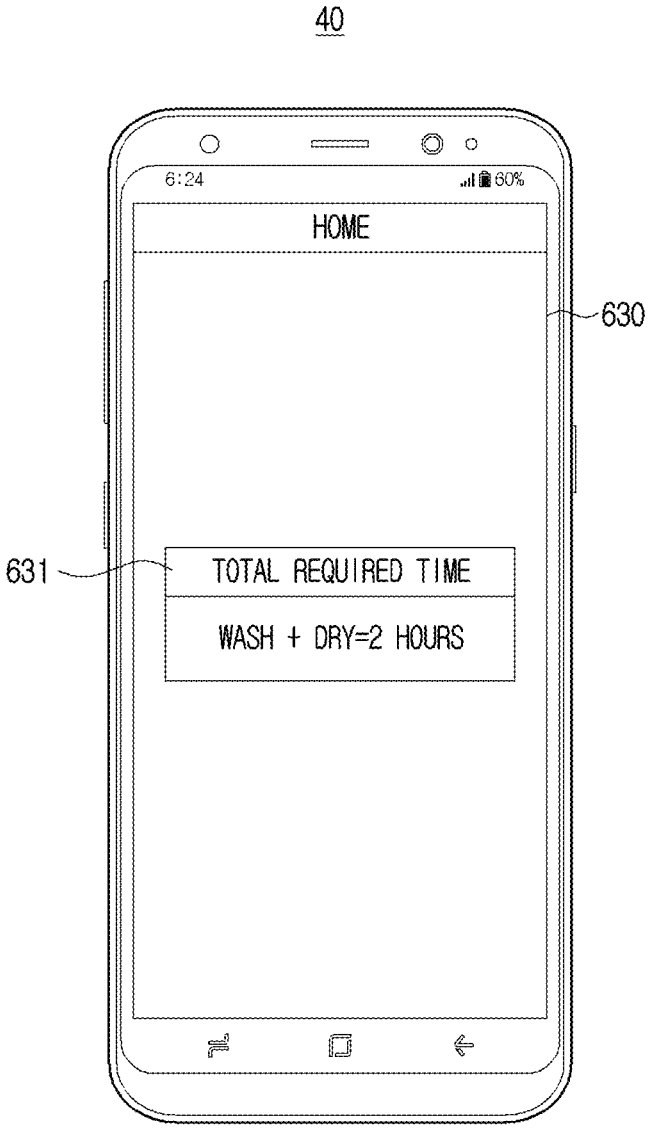

FIGS. 6A to 6C illustrate UI screens when the electronic apparatus 200 is implemented as the user terminal 40.

FIG. 6A illustrates a UI screen provided when a specific application is executed, and an icon image representing a controllable home appliance may be provided on a UI screen 610. Here, when the icon 611 of a washing machine is selected by the user's touch input, a UI screen 620 including washing course information may be provided as shown in FIG. 6B. In addition, a navigation GUI 622 for selecting washing course information may be provided. Also, in this case, drying course information 623 corresponding to the selected washing course information may be automatically mapped and provided. However, the user may also select the drying course information in some cases. As shown in FIG. 6C, a UI screen 630 including information on a total required time 631 according to the washing process and the drying process may be provided.

In addition, the electronic apparatus 200 may further include various input/output interfaces (not shown), a speaker (not shown), and a microphone (not shown). A microphone is a component for receiving the user's voice or other sounds and converting it into audio data. For example, information included in the UI screen according to various embodiments of the disclosure may be provided as a voice through a speaker (not shown), and a user command may be inputted as a voice through a microphone (not shown).

Figure 7:
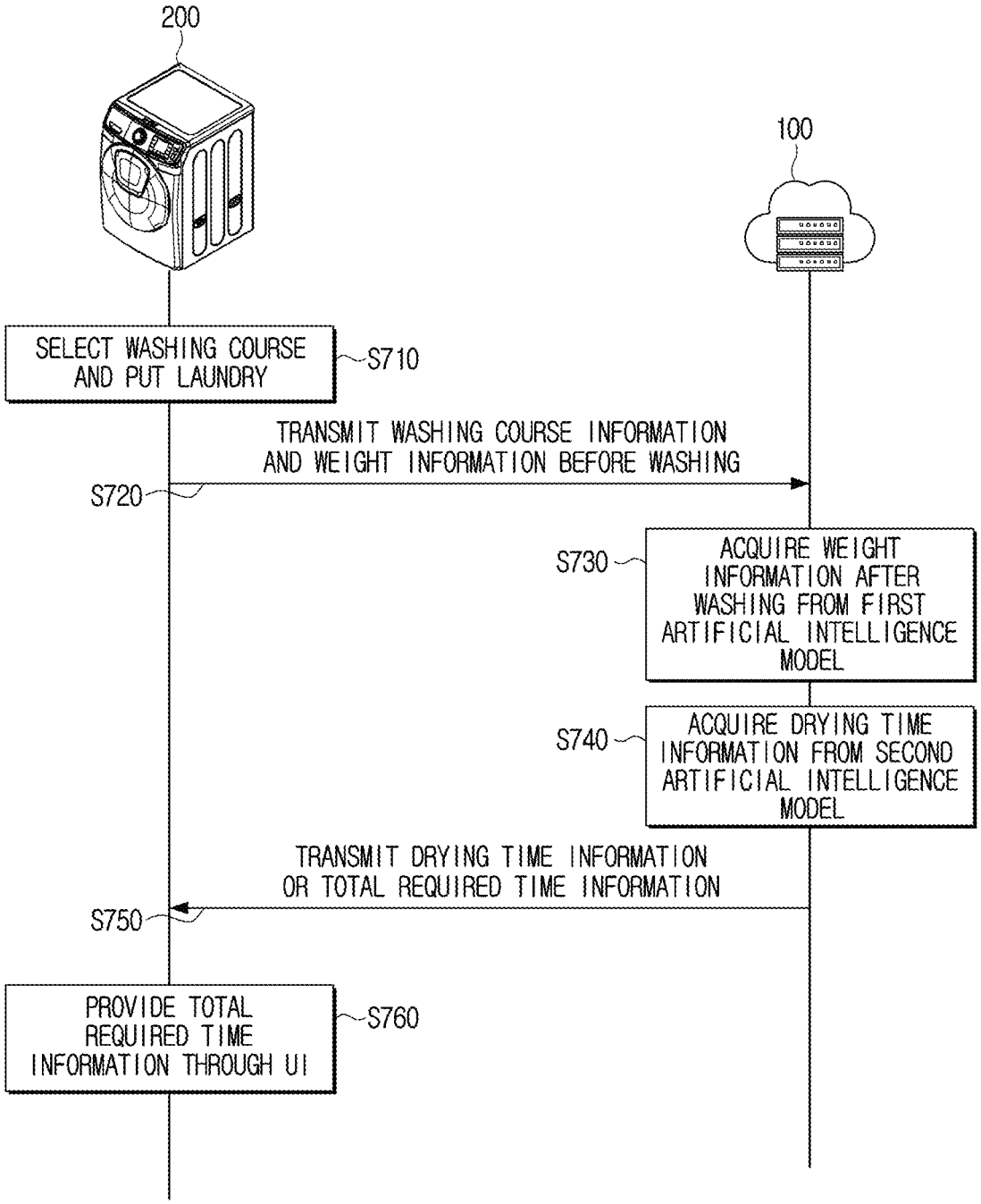
FIG. 7 illustrates a sequence diagram of an operation of an electronic system according to an embodiment.

FIG. 7 illustrates a sequence diagram of an operation of an electronic system according to an embodiment.

FIG. 7 assumes that the electronic apparatus 200 is implemented as the washing machine 10 shown in FIGS. 1A and 1B.

According to the sequence diagram shown in FIG. 7, when laundry is put into the electronic apparatus 200, that is, the washing machine 10, and when a washing course is selected (S710), the washing machine 10 may transmit washing course information and weight information before washing to the electronic apparatus 100 (S720).

The electronic apparatus 100 may acquire weight information after washing by inputting the washing course information and weight information before washing received from the washing machine 10 into the first artificial intelligence model (S730).

The electronic apparatus 100 may acquire drying time information by inputting the acquired weight information after washing and drying course information into the second artificial intelligence model (S740).

The electronic apparatus 100 may transmit the acquired drying time information or total required time information (drying time information+washing time information) to the washing machine 10 (S750).

In this case, the washing machine 10 may provide the total required time information through the UI based on the drying time information or total required time information (drying time information+washing time information) received from the electronic apparatus 100 (S760)

Figure 8:
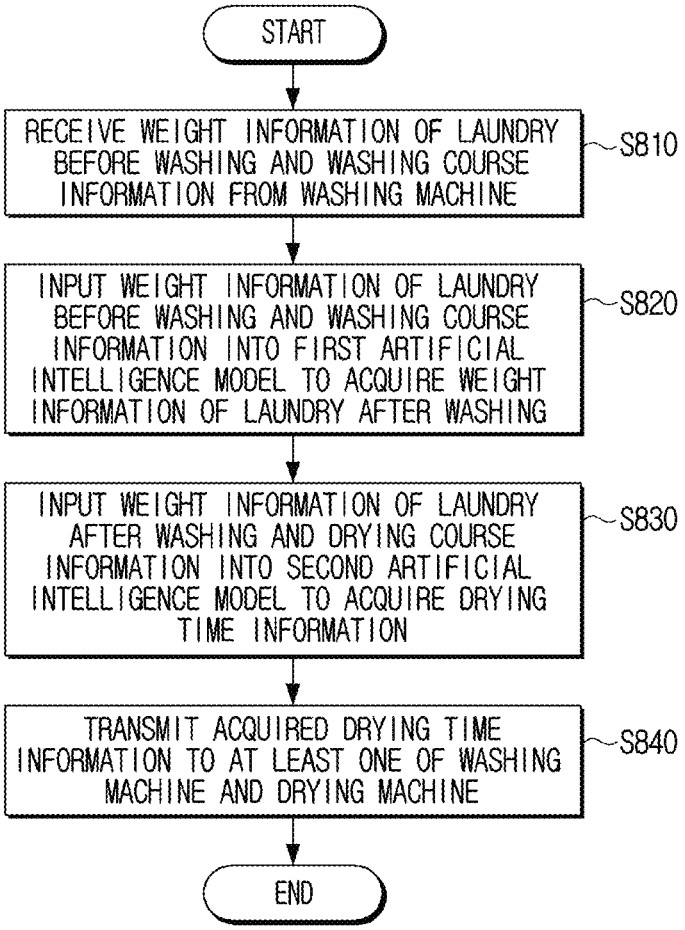
FIG. 8 illustrates a flowchart of a method of controlling an electronic apparatus according to an embodiment.

FIG. 8 illustrates a flowchart of a method of controlling an electronic apparatus according to an embodiment.

According to the method of the electronic apparatus shown in FIG. 8, when weight information of laundry before washing and washing course information are received from the washing machine (S810), the received weight information of laundry before washing and washing course information may be input into the trained first artificial intelligence model to acquire weight information of the laundry after washing (S820). Here, the weight information of the laundry before washing may include at least one of the weight of the dried laundry before washing and the weight of the wet laundry before washing.

The acquired laundry weight information after washing and drying course information may be input into the second artificial intelligence model to acquire drying time information that is used for a drying process (S830).

Thereafter, the acquired drying time information may be transmitted to at least one of a washing machine and a drying machine (S840).

Also, in operation S840, total required time information may be acquired based on the laundry time information corresponding to the washing course information and the acquired drying time information, and transmit the acquired total required time information to the washing machine.

In addition, the control method may further include receiving washing time information corresponding to the washing course information from the washing machine.

Also, the control method may further include acquiring drying course information corresponding to the washing course information based on the received washing course information.

In this case, the first artificial intelligence model may be trained by using the weight information of the laundry before washing and the washing course information as input data and using the weight information of the laundry after washing as output data. In addition, the second artificial intelligence model may be trained by using the weight information of the laundry after washing and drying course information as input data and using the drying time information as output data.

Also, the control method may further include receiving washing course information and drying course information corresponding to the washing course information from the user terminal.

In addition, the control method may further include acquiring total required time information based on washing time information corresponding to the washing course information and the acquired drying time information, and transmitting the acquired total required time information to the user terminal through the communication interface.

Also, in operation S820, weight information of laundry before washing, washing course information, and washing option information may be input to the first artificial intelligence model to acquire weight information of laundry after washing. Also, in operation S830, weight information of laundry after washing, drying course information, and drying option information may be input to the second artificial intelligence model to acquire drying time information.

According to various embodiments described above, since it is possible to provide a total time required for washing and drying processes at the start of washing, the user's convenience is improved.

The methods according to the above-described example embodiments may be realized as software or applications that may be installed in the existing electronic apparatus.

Further, the methods according to the above-described example embodiments may be realized by upgrading the software or hardware of the existing electronic apparatus.

The above-described example embodiments may be executed through an embedded server in the electronic apparatus or through an external server outside the electronic apparatus.

According to an embodiment, the various embodiments described above may be implemented as software including instructions stored in a machine-readable storage media which is readable by a machine (e.g., a computer). The device may include the electronic device according to the disclosed embodiments, as a device which calls the stored instructions from the storage media and which is operable according to the called instructions. When the instructions are executed by a processor, the processor may directory perform functions corresponding to the instructions using other components or the functions may be performed under a control of the processor. The instructions may include code generated or executed by a compiler or an interpreter. The machine-readable storage media may be provided in a form of a non-transitory storage media. The 'non-transitory' means that the storage media does not include a signal and is tangible, but does not distinguish whether data is stored semi-permanently or temporarily in the storage media.

In addition, according to an embodiment, the methods according to various embodiments described above may be provided as a part of a computer program product. The computer program product may be traded between a seller and a buyer. The computer program product may be distributed in a form of the machine-readable storage media (e.g., compact disc read only memory (CD-ROM) or distributed online through an application store (e.g., PLAYSTORE™). In a case of the online distribution, at least a portion of the computer program product may be at least temporarily stored or provisionally generated on the storage media such as a manufacturer's server, the application store's server, or a memory in a relay server.

Further, each of the components (e.g., modules or programs) according to the various embodiments described above may be composed of a single entity or a plurality of entities, and some subcomponents of the above-mentioned subcomponents may be omitted or the other subcomponents may be further included to the various embodiments. Generally, or additionally, some components (e.g., modules or programs) may be integrated into a single entity to perform the same or similar functions performed by each respective component prior to integration. Operations performed by a module, a program module, or other component, according to various exemplary embodiments, may be sequential, parallel, or both, executed iteratively or heuristically, or at least some operations may be performed in a different order, omitted, or other operations may be added.

While the disclosure has been shown and described with reference to various embodiments thereof, it will be understood by those skilled in the art that various changes in form and details may be made therein without departing from the spirit and scope of the disclosure as defined by the appended claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. An electronic apparatus comprising:

a memory configured to store information on a first artificial intelligence model that is trained and second artificial intelligence model that is trained;

a communication interface; and a processor operably coupled to the memory and the communication interface, the processor configured to:

based on weight information of laundry before washing and washing course information being received from a washing machine, input the received weight information of the laundry before washing and the washing course information into the first artificial intelligence model to acquire weight information of the laundry after washing, input the acquired weight information of the laundry after washing and drying course information into the second artificial intelligence model to acquire drying time information for a drying process, and transmit the acquired drying time information to at least one of the washing machine or a drying machine through the communication interface, wherein based on washing time information corresponding to the washing course information and the acquired drying time information, the processor is configured to:

acquire total required time information, and transmit the acquired total required time information to the washing machine through the communication interface before a start of the washing course.

2. The electronic apparatus of claim 1, wherein the processor is further configured to receive the washing time information corresponding to the washing course information from the washing machine.

3. The electronic apparatus of claim 1, wherein the weight information of the laundry before washing includes at least one of a weight of dried laundry before washing or a weight of wet laundry before washing.

4. The electronic apparatus of claim 1, wherein the processor is further configured to acquire the drying course information corresponding to the washing course information based on the received washing course information.

5. The electronic apparatus of claim 1, wherein:

the first artificial intelligence model is configured to be trained by using weight information of laundry before washing and washing course information as input data and weight information of the laundry after washing as output data, and the second artificial intelligence model is configured to be trained by using weight information of laundry after washing and drying course information as input data and drying time information as output data.

6. The electronic apparatus of claim 1, wherein the processor is configured to receive the washing course information and the drying course information corresponding to the washing course information from a user terminal through the communication interface.

7. The electronic apparatus of claim 6, wherein the processor is configured to:

acquire total required time information based on washing time information corresponding to the washing course information and the acquired drying course information, and transmit the acquired total required time information to the user terminal through the communication interface.

8. The electronic apparatus of claim 1, wherein the processor is further configured to:

input the weight information of the laundry before washing, the washing course information, and washing option information into the first artificial intelligence model to acquire the weight information of the laundry after washing, and input the weight information of the laundry after washing, the drying course information, and drying option information into the second artificial intelligence model to acquire drying time information.

9. An electronic system including a washing machine comprising:

a display; and a processor operably coupled to the display, the processor configured to:

transmit weight information of laundry before washing and washing course information to an electronic apparatus, and based on drying time information corresponding to a drying process predicted by the electronic apparatus being received, based on the received drying time information and washing time information corresponding to the washing course information, control the display to display total required time information prior to starting a washing course, and wherein the electronic system includes an electronic apparatus comprising a processor configured to:

input the weight information of the laundry received from the washing machine and the washing course information into a first artificial intelligence model to acquire weight information of the laundry after washing, input the acquired weight information of the laundry after washing and drying course information into a second artificial intelligence model to acquire the drying time information, and transmit the acquired drying time information to the washing machine.

10. A method for controlling an electronic apparatus that stores information on a first artificial intelligence model that is trained and a second artificial intelligence model that is trained, the method comprising:

based on weight information of laundry before washing and washing course information being received from a washing machine, inputting the received weight information of the laundry before washing and the washing course information into the first artificial intelligence model to acquire weight information of the laundry after washing;

inputting the acquired weight information of the laundry after washing and drying course information into the second artificial intelligence model to acquire drying time information for a drying process; and transmitting the acquired drying time information to at least one of the washing machine or a drying machine, wherein transmitting the acquired drying time information to at least one of the washing machine or the drying machine comprises:

acquiring total required time information based on washing time information corresponding to the washing course information and the acquired drying time information, and transmitting the acquired total required time information to the washing machine before a start of the washing course.

11. The method of claim 10, further comprising:

receiving the washing time information corresponding to the washing course information from the washing machine.

12. The method of claim 10, wherein the weight information of the laundry before washing includes at least one of a weight of dried laundry before washing or a weight of wet laundry before washing.

13. The method of claim 10, further comprising:

acquiring the drying course information corresponding to the washing course information based on the received washing course information.

14. The method of claim 10, wherein:

the first artificial intelligence model is trained by using weight information of laundry before washing and washing course information as input data and weight information of the laundry after washing as output data, and the second artificial intelligence model is trained by using weight information of laundry after washing and drying course information as input data and drying time information as output data.

15. The method of claim 10, further comprises receiving the washing course information and the drying course information corresponding to the washing course information from a user terminal.

16. The method of claim 15, further comprising:

acquiring a total required time information based on washing time information corresponding to the washing course information and the acquired drying course information; and transmitting the acquired total required time information to the user terminal.

17. The method of claim 10, further comprising:

inputting the weight information of the laundry before washing, the washing course information, and washing option information into the first artificial intelligence model to acquire the weight information of the laundry after washing, and inputting the weight information of the laundry after washing, the drying course information, and drying option information into the second artificial intelligence model to acquire drying time information.

18. The method of claim 10, wherein weight information of laundry before washing and washing course information being received after the laundry is placed into the washing machine.

* * * * *